US009822719B2

(12) United States Patent
Dudar et al.

(10) Patent No.: US 9,822,719 B2
(45) Date of Patent: Nov. 21, 2017

(54) SYSTEMS AND METHODS FOR FUEL VAPOR CANISTER PURGE

(71) Applicant: Ford Global Technologies, LLC, Dearborn, MI (US)

(72) Inventors: Aed M. Dudar, Canton, MI (US); Donald Ignasiak, Farmington Hills, MI (US); Dennis Seung-Man Yang, Canton, MI (US); Russell Randall Pearce, Ann Arbor, MI (US); Mark W. Peters, Wolverine Lake, MI (US); Niels Christopher Kragh, Commerce Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/064,811

(22) Filed: Mar. 9, 2016

(65) Prior Publication Data

US 2017/0260918 A1 Sep. 14, 2017

(51) Int. Cl.

| | |
|---|---|
| ***F02M 33/04*** | (2006.01) |
| ***F02D 41/00*** | (2006.01) |
| ***F02M 25/08*** | (2006.01) |
| ***F02D 41/14*** | (2006.01) |
| ***F02M 35/10*** | (2006.01) |

(52) U.S. Cl.

CPC ..... *F02D 41/0042* (2013.01); *F02D 41/1454* (2013.01); *F02M 25/089* (2013.01); *F02M 25/0836* (2013.01); *F02M 25/0854* (2013.01); *F02M 35/10222* (2013.01)

(58) Field of Classification Search

CPC ..... F02D 41/0042; F02D 41/1454; F02M 25/0854; F02M 25/089; F02M 25/0836; F02M 35/10222

USPC ..... 123/516, 518, 519, 520

See application file for complete search history.

(56) References Cited

U.S. PATENT DOCUMENTS

| | | | |
|---|---|---|---|
| 4,944,276 | A | 7/1990 | House et al. |
| 5,115,785 | A | 5/1992 | Cook |
| 5,289,811 | A | 3/1994 | Covert et al. |
| 5,878,725 | A | 3/1999 | Osterbrink |
| 6,202,632 | B1 | 3/2001 | Geiger et al. |
| 6,823,850 | B1 | 11/2004 | Hurley |
| 7,131,322 | B2 | 11/2006 | Booms et al. |
| 7,373,930 | B1 | 5/2008 | Hadre |
| 8,019,525 | B2 * | 9/2011 | DeBastos ..... B60K 15/03504 123/520 |

(Continued)

*Primary Examiner* — Hai Huynh

(74) *Attorney, Agent, or Firm* — James Dottavio; McCoy Russell LLP

(57) ABSTRACT

Methods and systems are provided for controlling the purging of a fuel vapor canister coupled to a vehicle fuel tank, configured for capturing and storing vapors emanating from the tank. In one example, two canister purge valves are coupled in series in a fuel vapor conduit between the fuel vapor canister and engine intake, one at the intake manifold and one at the fuel vapor canister, such that fine control over the introduction of fuel vapors into the engine is maintained via the purge valve at the intake manifold, while thorough purging of the fuel vapor canister may be regulated via the purge valve at the fuel vapor canister. In this way, fuel vapors in the fuel vapor canister may be effectively purged to intake, thus reducing the potential for undesired evaporative emissions.

20 Claims, 6 Drawing Sheets

(56) References Cited

U.S. PATENT DOCUMENTS

| | | | | |
|---|---|---|---|---|
| 8,056,540 | B2 * | 11/2011 | DeBastos | F02M 25/0818 123/520 |
| 8,447,495 | B2 * | 5/2013 | Pearce | B60K 15/03504 123/516 |
| 8,483,934 | B2 * | 7/2013 | Cunningham | F02D 37/02 123/520 |
| 9,222,443 | B2 * | 12/2015 | Peters | F02M 25/08 |
| 9,279,397 | B2 * | 3/2016 | Werner | F02M 25/089 |
| 9,410,508 | B2 * | 8/2016 | Ide | F02M 25/089 |
| 9,464,601 | B2 * | 10/2016 | Bolger | F02M 25/0836 |
| 9,574,525 | B2 * | 2/2017 | Matsunaga | B60K 15/03519 |
| 2014/0174411 | A1 * | 6/2014 | Matsunaga | F02M 25/0809 123/520 |
| 2015/0292421 | A1 * | 10/2015 | Pursifull | F02D 41/004 123/518 |
| 2016/0369713 | A1 * | 12/2016 | Pursifull | F02M 25/0836 |
| 2017/0045007 | A1 * | 2/2017 | Pursifull | F02D 41/0032 |

* cited by examiner

SYSTEMS AND METHODS FOR FUEL VAPOR CANISTER PURGE

FIELD

The present description relates generally to methods and systems for controlling a vehicle engine to thoroughly purge a fuel vapor canister.

BACKGROUND/SUMMARY

Vehicle emission control systems may be configured to store fuel vapors from fuel tank refueling and diurnal engine operations in a fuel vapor canister, and then purge the stored vapors during a subsequent engine operation. The stored vapors may be routed to engine intake for combustion, further improving fuel economy.

In a typical canister purge operation, a canister purge valve coupled between the engine intake and the fuel canister is opened, allowing for intake manifold vacuum to be applied to the fuel canister. Simultaneously, a canister vent valve coupled between the fuel canister and atmosphere is opened, allowing for fresh air to enter the canister. This configuration facilitates desorption of stored fuel vapors from the adsorbent material in the canister, regenerating the adsorbent material for further fuel vapor adsorption.

However, fresh air flow within and through the canister is not uniform. Regions of adsorbent that see relatively less air flow will retain relatively more adsorbed hydrocarbons. Typically, 10-15% of the canister will retain some quantity of hydrocarbons following a purge operation, and this amount may increase as the canister ages. The residual hydrocarbons may desorb over a diurnal cycle, leading to an increase in bleed emissions. Strategies to limit these bleed emissions have included secondary canisters and heating elements, both of which increase manufacturing costs and require additional diagnostic testing.

Furthermore, current and future engine systems may be configured to operate under relatively low manifold vacuum conditions. While this may increase engine efficiency, it also reduces the opportunities for fuel vapor canister purging. This may particularly apply to hybrid vehicles, which have a limited engine run time to begin with. For example, limited engine run time in hybrid electric vehicles (HEVs) may limit engine manifold vacuum, thus decreasing opportunities for canister purging operations. Even if purge conditions are met, the conditions may only be held for a short period of time, leading to incomplete purge cycles. This may result in residual fuel vapors stored in the canister for long periods of time. Typically, the canister is coupled to atmosphere while the vehicle is off. Over the course of a diurnal cycle, the fuel vapors may desorb from the canister as temperature rises, resulting in an increase in bleed emissions. The canister vent valve could be maintained closed, but the vent valve is typically a solenoid valve requiring constant power to stay shut, which could drain the battery if the vehicle is left off for a significant period of time.

The canister purge valve is typically located at the intake manifold. Positioning the canister purge valve at the intake manifold serves to limit hydrocarbon transport delay between the canister purge valve and engine cylinders. For example, if a canister is loaded with fuel vapors and the canister purge valve were located away from the intake manifold near the canister, by the time exhaust gas sensors indicate that canister load is high, a stall condition may occur due to rich air/fuel mixture in the intake. As such, it is desirable to have the canister purge valve as close to the cylinders as possible (i.e. mounted onto the intake manifold) to prevent engine drivability issues such as hesitation, surge, or even stall. However, with the canister purge valve mounted at the intake, a significant pressure drop is observed in the vapor line between the intake manifold and the canister as a result of duty cycling the canister purge valve. Significantly, the vapor line between the canister and the canister purge valve can be as long as 8-10 feet in some vehicles. In such cases, the pressure drop results in a considerably reduced vacuum as seen at the canister, decreasing the ability of engine vacuum to thoroughly purge hydrocarbons from the canister. Systems and methods enabling precise control over purge flow rates when only low flow rates are desired, while additionally enabling sufficient vacuum to thoroughly purge the fuel vapor canister, would improve engine operations and reduce evaporative emissions.

US patent application U.S. Pat. No. 5,115,785 teaches a pulse width modulated solenoid-actuated canister purge valve and a vacuum-actuated canister purge valve arranged in parallel between engine intake and the fuel vapor canister. Below a certain duty cycle of the solenoid-actuated valve, only the solenoid-actuated valve is open. At higher duty cycles, both flow paths are open, resulting from the increased vacuum at higher duty cycles opening the vacuum-activated canister purge valve. As such, the system purports to enable control at low flow rates, but purports to be capable of higher flow rates. However, the inventors herein have recognized potential issues with such systems. As one example, responsive to vacuum above a threshold, the vacuum-actuated valve is always open, without the potential to be duty-cycled. In other words, duty cycling the solenoid-actuated valve, even at high rates where the vacuum-actuated valve is open, may still result in significant pressure drop between the intake manifold and the canister, thus decreasing the ability to effectively clean the canister.

US patent application U.S. Pat. No. 6,202,632 teaches a first controllable purge valve and a second controllable purge valve, arranged in parallel between an intake manifold and a fuel vapor canister. The first valve has a smaller flow cross-section than the second valve. As such, the first valve may be first opened (i.e. duty-cycled) for purging of the canister, and if greater flow is desired, the second valve may subsequently be opened. However, the inventors herein have recognized potential issues with such systems. As one example, U.S. Pat. No. 6,202,632 teaches that the first valve is controlled via a pulse-width modulated signal, whereas the second valve may only be directed to an open or closed position. As such, while greater flow may be attained with the second valve opened, the flow (and pressure drop) between the canister and intake manifold are strictly dependent on the level of intake manifold vacuum and the distance between the intake manifold and the canister. Accordingly, in some examples significant pressure drop may still be observed, thus reducing the ability to effectively clean the canister.

Thus, the inventors herein have developed systems and methods to at least partially address the above issues. In one example a method is provided, comprising during purging fuel vapors stored in a fuel vapor canister to an intake manifold of an engine, first duty cycling a first canister purge valve and commanding open a second canister purge valve, and then stopping duty cycling the first canister purge valve, opening the first canister purge valve, and commencing duty cycling the second canister purge valve responsive to a canister load below a threshold canister load.

As one example, opening the first canister purge valve and duty cycling the second canister purge valve increases air flow through the fuel vapor canister as compared to duty cycling the first canister purge valve and opening the second canister purge valve. In this way, increased air flow to the fuel vapor canister may be provided under circumstances where it is indicated that canister load is below a threshold level, thus reducing potential engine stall conditions resulting from the introduction of fuel vapors into an engine under increased air flow. In one example, the first canister purge valve is coupled to the intake manifold and the second valve is coupled to the fuel vapor canister, and the first and second canister purge valves are arranged in series. By operating the first and second canister purge valves to selectively increase air flow to the fuel vapor canister, thorough cleaning of the fuel vapor canister may be accomplished during purging events, and may thus lead to reduced evaporative emissions, and prolonged fuel vapor canister lifetime.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
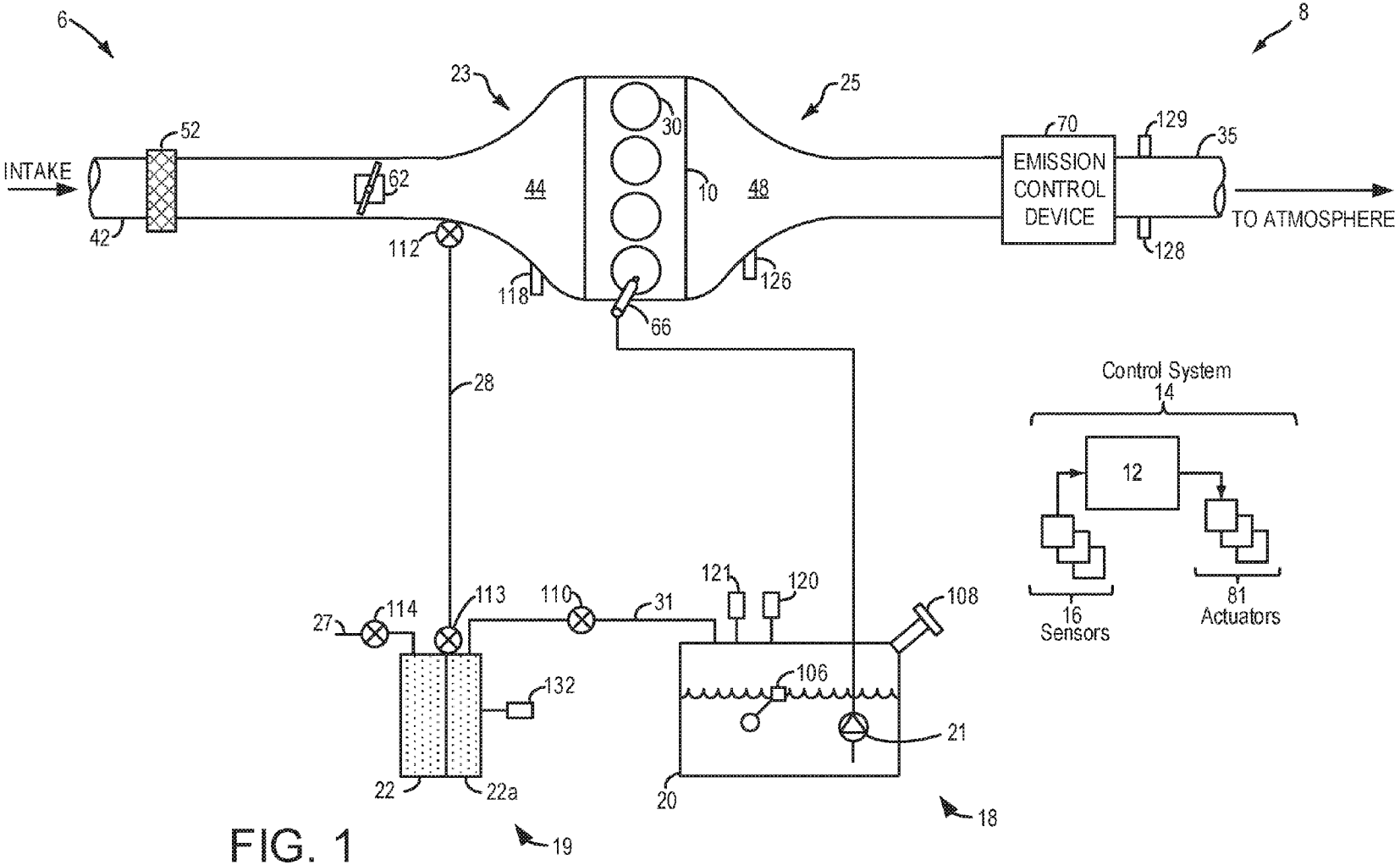
FIG. 1 shows a schematic depiction of a fuel system and evaporative emissions system coupled to an engine system where two canister purge valves are arranged in series.
Figure 2:
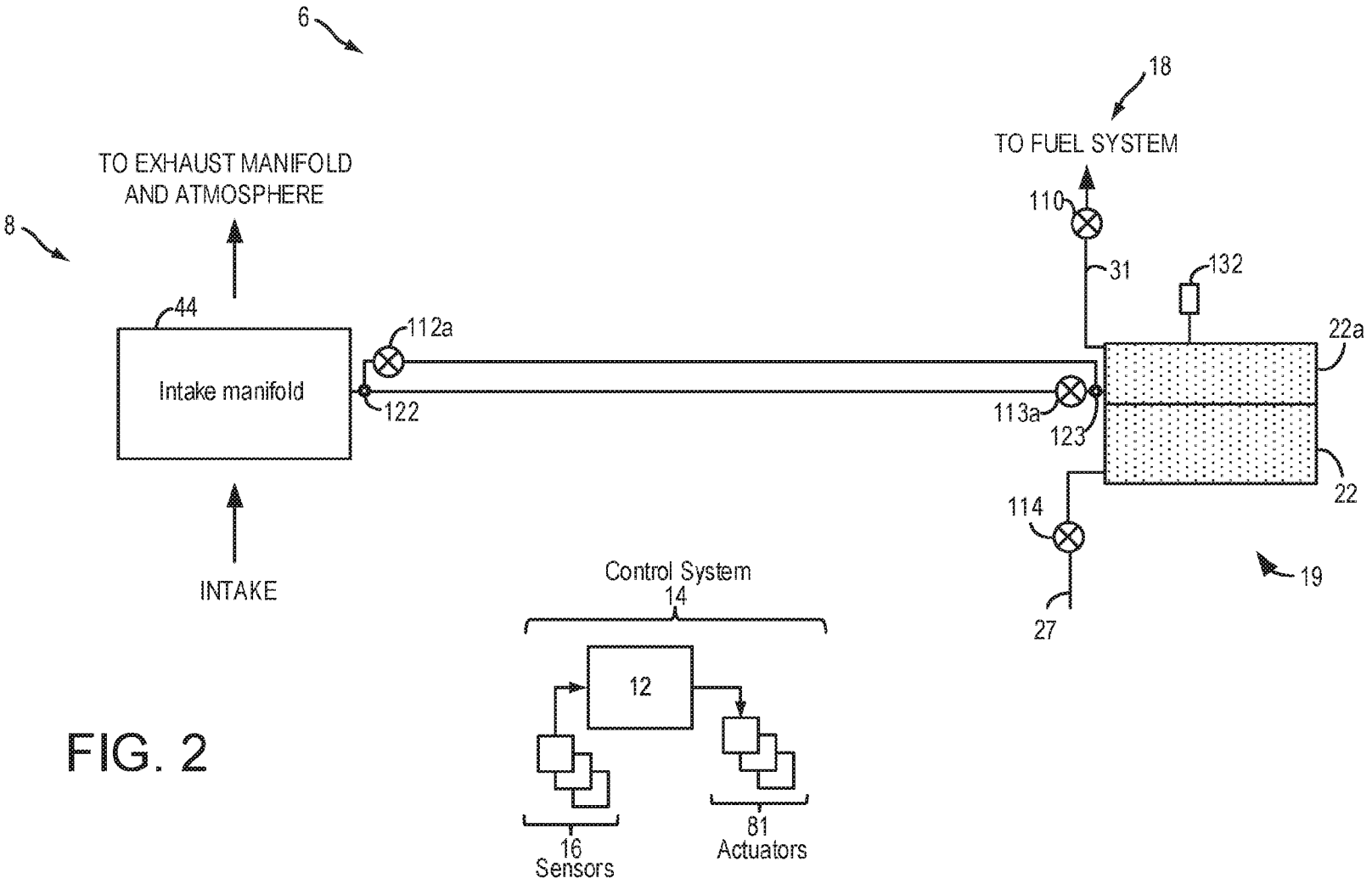
FIG. 2 shows a schematic depiction of an evaporative emissions system coupled to an engine system where two canister purge valves are arranged in parallel.
Figure 3:
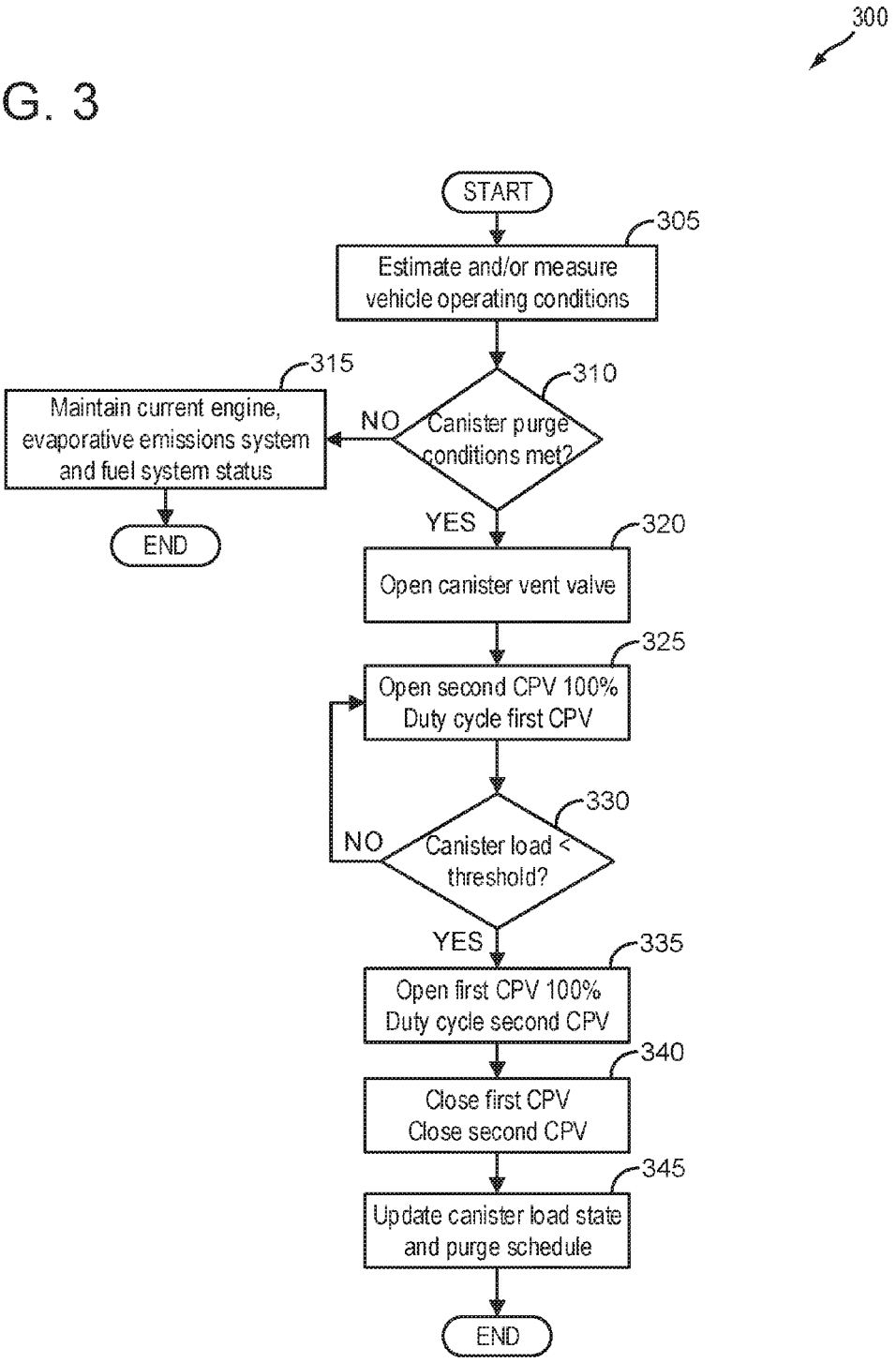
FIG. 3 shows a flowchart for a high level example method for performing a fuel vapor canister purging operation where two canister purge valves are arranged in series.
Figure 4:
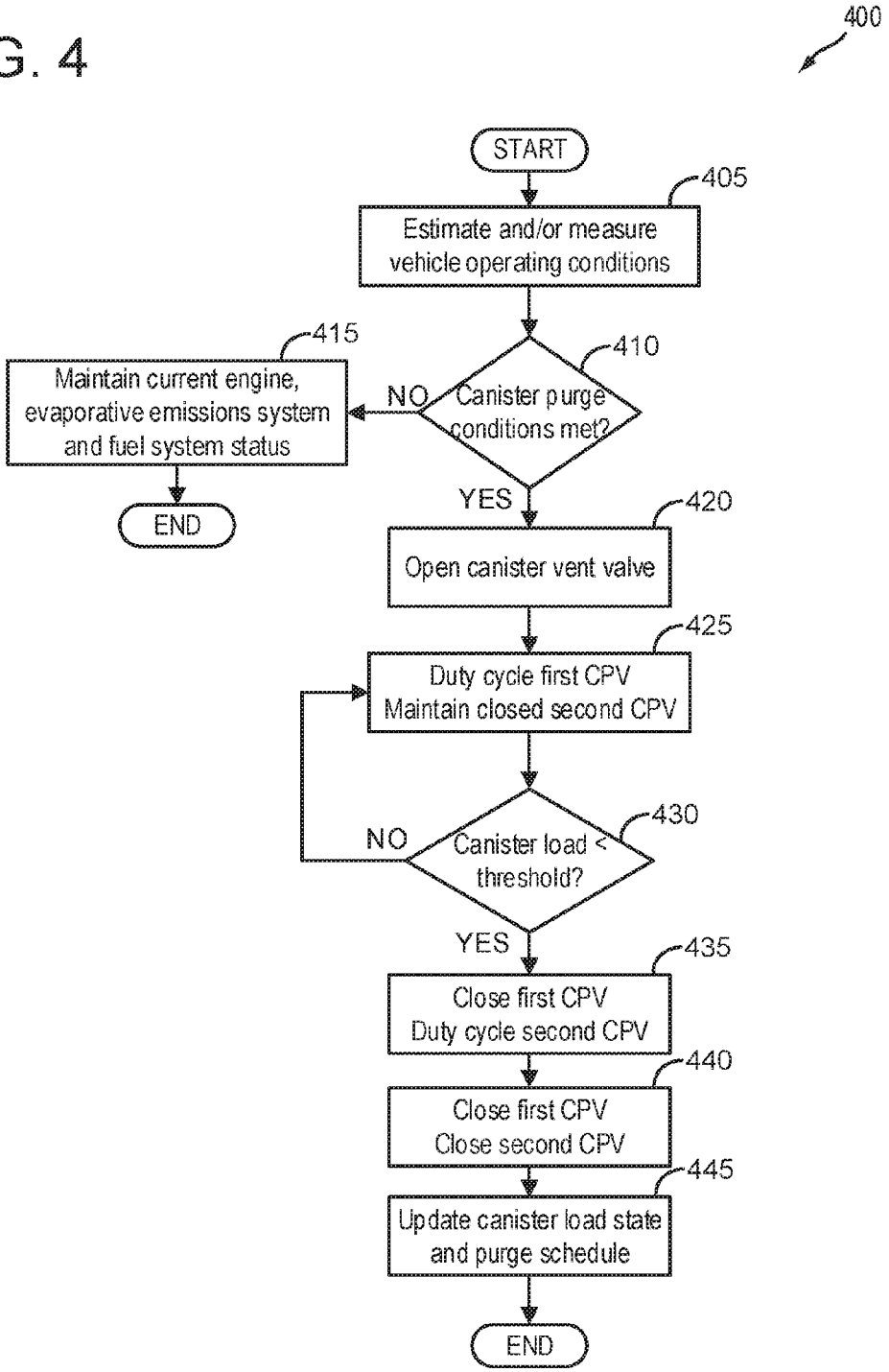
FIG. 4 shows a flowchart for a high level example method for performing a fuel vapor canister purging operation where two canister purge valves are arranged in parallel.
Figure 5:
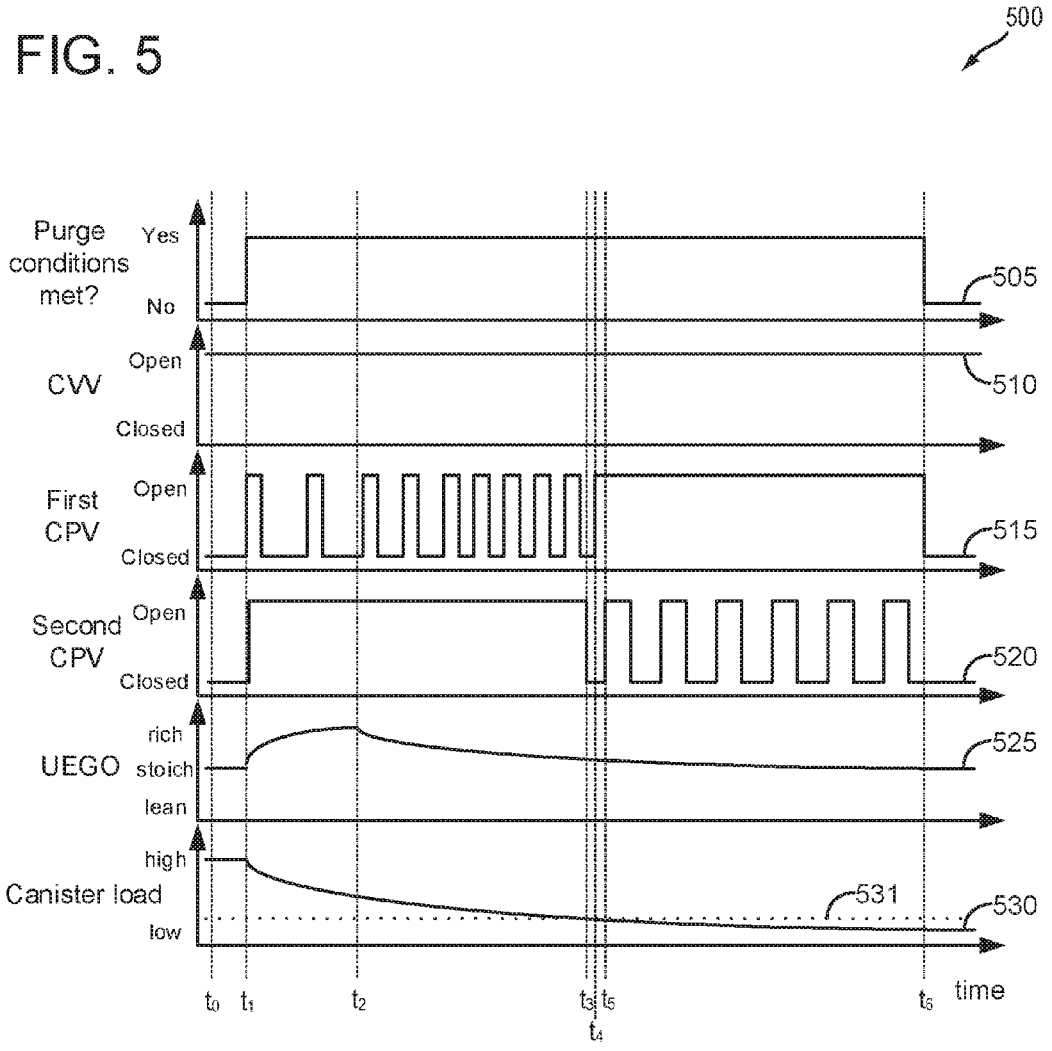
FIG. 5 shows an example timeline for purging a fuel vapor canister where two canister purge valves are arranged in series.
Figure 6:
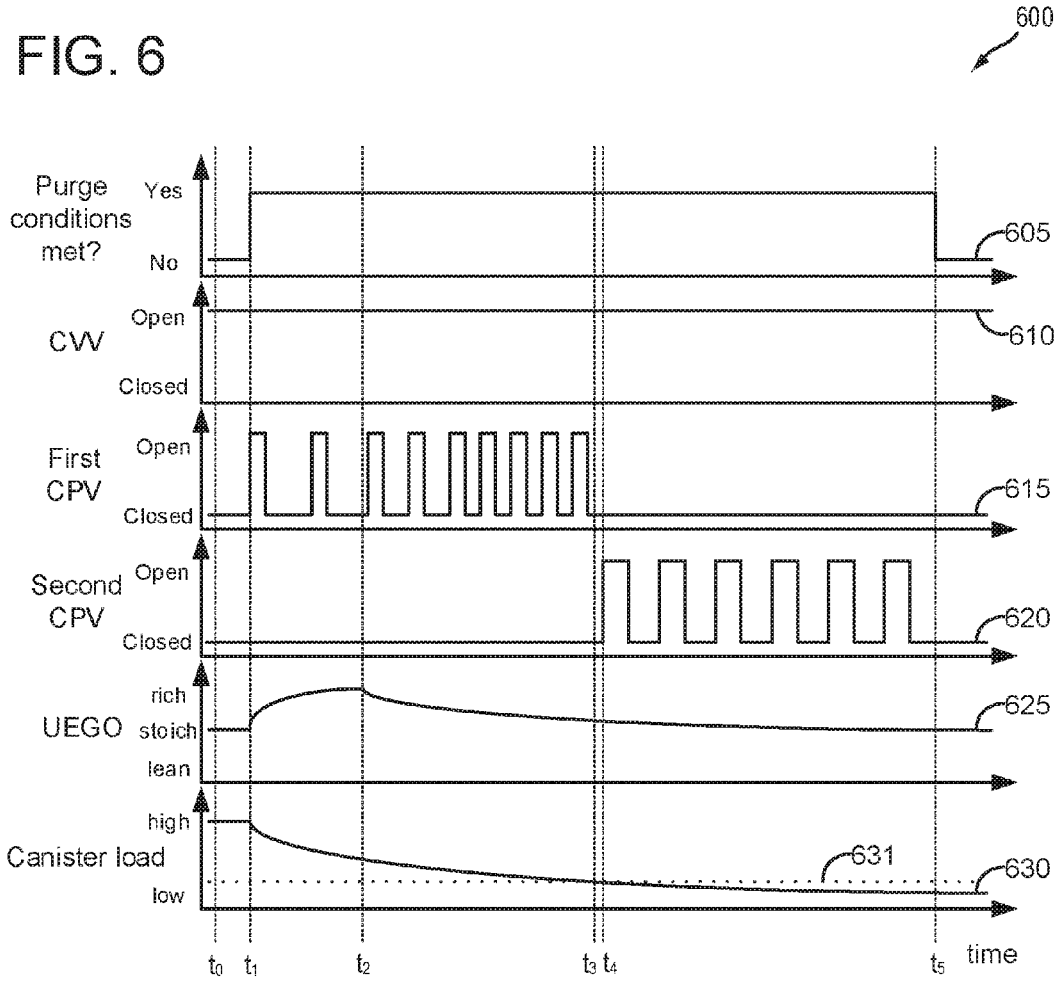
FIG. 6 shows an example timeline for purging a fuel vapor canister where two canister purge valves are arranged in parallel.

This detailed description relates to systems and methods for purging a fuel vapor canister in a vehicle evaporative emissions system where the canister is thoroughly purged of fuel vapor. Specifically, in one example, the description relates to purging a fuel vapor canister via the use of two canister purge valves arranged in series. A first canister purge valve is mounted at the intake manifold, whereas a second canister purge valve is mounted at the fuel vapor canister. In such an example, a method of purging the fuel vapor canister includes duty cycling the first canister purge valve upon initiation of a canister purging event, and commanding open (e.g., fully open) the second canister purge valve. Such an example may include a canister load above a predetermined threshold canister load, or an unknown canister load. Upon indication of canister load below the predetermined threshold canister load, the method includes opening (e.g., fully open) the first canister purge valve and duty cycling the second canister purge valve. In another example, the description relates to purging a fuel vapor canister via the use of two canister purge valves arranged in parallel. A first canister purge valve is close-coupled to the intake manifold, whereas a second canister purge valve close-coupled to the fuel vapor canister. In such an example, a method of purging the fuel vapor canister includes duty cycling the first canister purge valve upon initiation of a canister purge event, and commanding or maintaining closed the second canister purge valve. Upon indication of a canister load below a predetermined threshold canister load, the method includes closing the first canister purge valve, and duty cycling the second canister purge valve. By purging the fuel vapor canister according to the methods described above, thorough purging of the fuel vapor canister may be enabled, by reducing the pressure drop between intake manifold vacuum and the fuel vapor canister. The systems and methods described above may be applied to a vehicle system with an evaporative emissions system coupled to a fuel system and to an engine system, where the fuel vapor canister is coupled to the engine system via two canister purge valves arranged in series, as depicted in FIG. 1. In another example, the systems and methods described above may be applied to a vehicle system with an evaporative emissions system coupled to a fuel system and to an engine system, where the fuel vapor canister is coupled to the engine system via two canister purge valves arranged in parallel, as depicted in FIG. 2. A method for purging a fuel vapor canister where the fuel vapor canister is coupled to the engine system via two canister purge valves arranged in series is illustrated in FIG. 3. Alternatively, a method for purging a fuel vapor canister where the fuel vapor canister is coupled to the engine system via two canister purge valves arranged in parallel is illustrated in FIG. 4. A timeline for fuel vapor canister purging where two canister purge valves are arranged in series is illustrated in FIG. 5. A timeline for fuel vapor canister purging where two canister purge valves are arranged in parallel is illustrated in FIG. 6.

FIG. 1 shows a schematic depiction of a hybrid vehicle system 6 that can derive propulsion power from engine system 8 and/or an on-board energy storage device, such as a battery system. An energy conversion device, such as a generator (not shown), may be operated to absorb energy from vehicle motion and/or engine operation, and then convert the absorbed energy to an energy form suitable for storage by the energy storage device.

Engine system 8 may include an engine 10 (internal combustion engine) having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to a fuel system 18, and evaporative emissions system 19. Fuel system 18 includes a fuel tank 20 coupled to a fuel pump 21, the fuel tank supplying fuel to an engine 10 which propels a vehicle. Evaporative emissions system 19 includes fuel vapor canister 22. During a fuel tank refueling event, fuel may be pumped into the vehicle from an external source through refueling port 108. Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to deliver pressurized fuel to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, via conduit 31, before being purged to the engine intake 23.

Fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 by opening first canister purge valve 112 and second canister purge valve 113, details of which will be described in detail below. While a single canister 22 is shown, it will be appreciated that fuel system 18 may include any number of canisters. In one example, canister purge valve 112 and canister purge valve 113 may be a solenoid valve wherein opening or closing of the valve is performed via actuation of an associated canister purge solenoid. As depicted herein, first canister purge valve may be mounted to intake manifold 44, while second canister purge valve may be mounted to fuel vapor canister 22. As such, first canister purge valve 112 and second canister purge valve 113 may be connected in series via purge line 28.

Canister 22 may include a buffer 22*a* (or buffer region), each of the canister and the buffer comprising the adsorbent. As shown, the volume of buffer 22*a* may be smaller than (e.g., a fraction of) the volume of canister 22. The adsorbent in the buffer 22*a* may be same as, or different from, the adsorbent in the canister (e.g., both may include charcoal). Buffer 22*a* may be positioned within canister 22 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

Canister 22 includes a vent 27 for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28. While this example shows vent 27 communicating with fresh, unheated air, various modifications may also be used. Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. In one example, canister vent valve 114 may be a solenoid valve wherein opening or closing of the valve is performed via actuation of a canister vent solenoid. In particular, the canister vent valve may be in a normally open position that is closed upon actuation of the canister vent solenoid.

As such, hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, a fuel tank isolation valve 110 may be optionally included in conduit 31 such that fuel tank 20 is coupled to canister 22 via the valve. During regular engine operation, isolation valve 110 may be kept closed to limit the amount of diurnal or "running loss" vapors directed to canister 22 from fuel tank 20. During refueling operations, and selected purging conditions, isolation valve 110 may be temporarily opened, e.g., for a duration, to direct fuel vapors from the fuel tank 20 to canister 22. By opening the valve during purging conditions when the fuel tank pressure is higher than a threshold (e.g., above a mechanical pressure limit of the fuel tank), the refueling vapors may be released into the canister and the fuel tank pressure may be maintained below pressure limits. While the depicted example shows isolation valve 110 positioned along conduit 31, in alternate embodiments, the isolation valve may be mounted on fuel tank 20.

One or more pressure sensors 120 may be coupled to fuel system 18 for providing an estimate of a fuel system (and evaporative emissions system) pressure. In one example, the fuel system pressure, and in some examples evaporative emissions system pressure as well, is indicated by pressure sensor 120, where pressure sensor 120 is a fuel tank pressure transducer (FTPT) coupled to fuel tank 20. While the depicted example shows pressure sensor 120 directly coupled to fuel tank 20, in alternate embodiments, the pressure sensor may be coupled between the fuel tank and canister 22, specifically between the fuel tank and isolation valve 110. In still other embodiments, a first pressure sensor may be positioned upstream of the isolation valve (between the isolation valve and the canister) while a second pressure sensor is positioned downstream of the isolation valve (between the isolation valve and the fuel tank), to provide an estimate of a pressure difference across the valve. In some examples, a vehicle control system may infer and indicate undesired evaporative emissions based on changes in a fuel tank (and evaporative emissions system) pressure during an evaporative emissions diagnostic routine.

One or more temperature sensors 121 may also be coupled to fuel system 18 for providing an estimate of a fuel system temperature. In one example, the fuel system temperature is a fuel tank temperature, wherein temperature sensor 121 is a fuel tank temperature sensor coupled to fuel tank 20 for estimating a fuel tank temperature. While the depicted example shows temperature sensor 121 directly coupled to fuel tank 20, in alternate embodiments, the temperature sensor may be coupled between the fuel tank and canister 22.

Fuel vapors released from canister 22, for example during a purging operation, may be directed into engine intake manifold 44 via purge line 28. The flow of vapors along purge line 28 may be regulated by first canister purge valve 112, and second canister purge valve 113, coupled between the fuel vapor canister and the engine intake. The quantity and rate of vapors released by the first and second canister purge valves may be determined by the duty cycle of an associated canister purge valve solenoid (not shown). As such, the duty cycle of the first and second canister purge valve solenoids may be determined by the vehicle's powertrain control module (PCM), such as controller 12, responsive to engine operating conditions, including, for example, engine speed-load conditions, an air-fuel ratio, a canister load, etc. In an alternate embodiment, one or both of the canister purge valves may be variable orifice valves where flow through the valve is regulated by adjusting orifice size, as described in further detail below.

By commanding the first and second canister purge valves to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the first and second canister purge valves can be forced open by a high intake manifold pressure. An estimate of the manifold absolute pressure (MAP) or manifold vacuum (ManVac) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 and evaporative emissions system 19 may be operated by controller 12 in a plurality of modes by selective adjustment of the various valves and solenoids. For example, the fuel system and evaporative emissions system may be operated in a fuel vapor storage mode (e.g., during a fuel tank refueling operation and with the engine not running), wherein the controller 12 may open isolation valve 110 and canister vent valve 114 while closing first canister purge valve (CPV) 112 and closing second canister purge valve 113, to direct refueling vapors into canister 22 while preventing fuel vapors from being directed into the intake manifold.

As another example, the fuel system and evaporative emissions system may be operated in a refueling mode (e.g., when fuel tank refueling is requested by a vehicle operator), wherein the controller 12 may open isolation valve 110 and canister vent valve 114, while maintaining canister purge valve 112 closed, to depressurize the fuel tank before enabling fuel to be added therein. As such, isolation valve 110 may be kept open during the refueling operation to allow refueling vapors to be stored in the canister. After refueling is completed, the isolation valve may be closed.

As yet another example, the fuel system and evaporative emissions system may be operated in a canister purging mode (e.g., after an emission control device light-off temperature has been attained and with the engine running). In one example, the controller 12 may first duty cycle first canister purge valve 112 while commanding open second canister purge valve 113, and commanding open canister vent valve 114 while closing isolation valve 110. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging in this fashion may be continued until the stored fuel vapor amount in the canister is below a predetermined threshold canister load. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more exhaust gas oxygen sensors 126 may be positioned in the engine exhaust to provide an estimate of a canister load (that is, an amount of fuel vapors stored in the canister). Exhaust gas sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Based on the canister load, and further based on engine operating conditions, such as engine speed-load conditions, a purge flow rate may be determined. In one example, purging the canister may include indicating an air/fuel ratio via, for example, a proportional plus integral feedback controller coupled to a two-state exhaust gas oxygen sensor, and responsive to the air/fuel indication and a measurement of inducted air flow, generating a base fuel command. To compensate for purge vapors, a reference air/fuel ratio, related to engine operation without purging, may be subtracted from the air/fuel ratio indication and the resulting error signal (compensation factor) generated. As such, the compensation factor may represent a learned value directly related to fuel vapor concentration, and may be subtracted from the base fuel command to correct for the induction of fuel vapors.

In other examples (not shown), one or more oxygen sensors may be positioned in the engine intake 44, or coupled to the canister 22 (e.g., downstream of the canister), to provide an estimate of canister load. In still further examples, one or more temperature sensors 132 may be coupled to and/or within canister 22. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister, and may be used to estimate canister load.

Responsive to an indication that canister load is below a predetermined threshold canister load, first canister purge valve 112 may be commanded open, and canister purge valve 113 may be duty cycled. By commanding open canister purge valve 112 and duty cycling canister purge valve 113, the pressure drop between the intake manifold vacuum and the fuel vapor canister may be reduced as compared to the pressure drop between the intake manifold vacuum and the fuel vapor canister resulting from duty cycling first canister purge valve 112 and commanding open second canister purge valve 113. In other words, duty cycling second canister purge valve 113 with first canister purge valve 112 open directs intake manifold vacuum full force right at the canister. As such, air flow through the fuel vapor canister may be increased, resulting in further purging of the fuel vapor canister. Furthermore, by duty cycling first canister purge valve 112 with second canister purge valve 113 open until a predetermined threshold canister load is reached, and then duty cycling second canister purge valve 113 with first canister purge valve 112 open, potential stall conditions resulting from transport delay between the second canister purge valve 113 and exhaust gas oxygen sensor feedback may be avoided. For example, if the canister is loaded with fuel vapors and the first canister purge valve 112 were commanded open and the second canister purge valve 113 were duty cycled, by the time the exhaust gas oxygen sensor indicated that canister load is high, an engine stall condition may occur due to rich air/fuel mixture. By first duty cycling first canister purge valve 112 with second canister purge valve 113 open, and only duty cycling second canister purge valve 113 with first canister purge valve 112 open responsive to an indication of canister load below the predetermined threshold canister load, potential stall conditions may be avoided, while thorough purging of the fuel vapor canister may be achieved.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, MAP sensor 118, pressure sensor 120, and pressure sensor 129. Other sensors such as additional pressure, temperature, air/fuel ratio, and composition sensors may be coupled to various locations in the vehicle system 6. As another example, the actuators may include fuel injector 66, isolation valve 110, first canister purge valve 112, second canister purge valve 113, vent valve 114, fuel pump 21, and throttle 62.

Control system 14 may further receive information regarding the location of the vehicle from an on-board global positioning system (GPS). Information received from the GPS may include vehicle speed, vehicle altitude, vehicle position, etc. This information may be used to infer engine operating parameters, such as local barometric pressure. Control system 14 may further be configured to receive information via the internet or other communication networks. Information received from the GPS may be cross-referenced to information available via the internet to determine local weather conditions, local vehicle regulations, etc. Control system 14 may use the internet to obtain updated software modules which may be stored in non-transitory memory.

The control system 14 may include a controller 12. Controller 12 may be configured as a conventional microcomputer including a microprocessor unit, input/output ports, read-only memory, random access memory, keep alive memory, a controller area network (CAN) bus, etc. Controller 12 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines. An example control routine is described herein with regard to FIG. 3 and FIG. 4.

Controller 12 may also be configured to intermittently perform evaporative emissions detection routines on fuel system 18 and evaporative emissions system 19 to confirm that the evaporative emissions system is not degraded. As such, various diagnostic evaporative emissions detection tests may be performed while the engine is off (engine-off evaporative emissions test) or while the engine is running (engine-on evaporative emissions test). Evaporative emissions tests performed while the engine is running may include applying a negative pressure on the fuel system and evaporative emissions system for a duration (e.g., until a target vacuum is reached) and then sealing the fuel system and evaporative emissions system while monitoring a change in pressure (e.g., a rate of change in the vacuum level, or a final pressure value). Evaporative emissions tests performed while the engine is not running may include sealing the fuel system and evaporative emissions system following engine shut-off and monitoring a change in pressure. This type of evaporative emissions test is referred to herein as an engine-off natural vacuum test (EONV). In sealing the fuel system and evaporative emissions system following engine shut-off, pressure in such a fuel system and evaporative emissions control system will increase if the tank is heated further (e.g., from hot exhaust or a hot parking surface) as liquid fuel vaporizes. If the pressure rise meets or exceeds a predetermined threshold, it may be indicated that the fuel system and the evaporative emissions control system are free from undesired evaporative emissions. Alternatively, if during the pressure rise portion of the test the pressure curve reaches a zero-slope prior to reaching the threshold, as fuel in the fuel tank cools, a vacuum is generated in the fuel system and evaporative emissions system as fuel vapors condense to liquid fuel. Vacuum generation may be monitored and undesired emissions identified based on expected vacuum development or expected rates of vacuum development. The EONV test may be monitored for a period of time based on available battery charge.

In still other examples, undesired evaporative emissions tests may be conducted by actively pressurizing or evacuating the evaporative emissions system, or the evaporative emissions system and the fuel system, via an onboard pump (not shown), which may be positioned in vent 27.

Turning now to FIG. 2, an alternative example of an evaporative emissions system coupled to a fuel system and engine system is shown. Components that are the same as those illustrated in FIG. 1 are denoted by the same reference number. FIG. 2 shows a simplified version of the schematic depiction of hybrid vehicle system 6 illustrated in FIG. 1. It should be understood that the simplification of FIG. 2 is for illustration purposes only, and all components otherwise detailed in FIG. 1 also apply to vehicle system 6 shown in FIG. 2, with the exception of those components that differ between FIG. 1 and FIG. 2. As such, FIG. 2 shows a schematic depiction of a hybrid vehicle system 6, wherein engine system 8 is coupled to a fuel system 18, and evaporative emissions system 19, as described above with regard to FIG. 1. A first purge line 26 extends from the intake manifold 44 to the fuel vapor canister 22. A second purge line 29 couples at a first junction 122 to the first purge line 26, and further couples to the first purge line 26 at a second junction 123. A first canister purge valve 112*a* regulates the flow of air/fuel vapor through the second purge line 29. A second canister purge valve 113*a* regulates the flow of air/fuel vapor through the first purge line 26. First canister purge valve 112*a* is close-coupled to the intake manifold 44, while second canister purge valve 113*a* is close-coupled to the fuel vapor canister 22. In some examples, the distance between the intake manifold 44 and the first canister purge valve 112*a* is roughly the same distance as the distance between the fuel vapor canister 22 and the second canister purge valve 113*a*. In still other examples, the first canister purge valve 112*a* may be positioned as close to the intake manifold 44 as possible upstream of first junction 122, and the second canister purge valve 113*a* may be positioned as close as possible to the fuel vapor canister 22 downstream of second junction 123. Furthermore, in such an example, first junction 122 may be positioned as close as possible to the intake manifold 44 and the second junction 123 may be positioned as close as possible to the fuel vapor canister 22. As described above with regard to FIG. 1 and which will be described in further detail below, positioning a first canister purge valve 112*a* close to the intake manifold 44 reduces lag time, or "transport delay" between the first canister purge valve 112*a* and the engine cylinders. Alternatively, positioning a second canister purge valve 113*a* close to the fuel vapor canister may reduce the pressure drop between intake manifold vacuum and the fuel vapor canister, which may promote enhanced purging of the fuel vapor canister under some conditions.

In some examples, the first canister purge valve may comprise a "low flow" valve, while the second canister purge valve may comprise a "high flow" valve. As such, the first canister purge valve may comprise a smaller flow cross section than that of the second canister purge valve.

As described above with regard to FIG. 1, the quantity and rate of vapors released by the first and second canister purge valves may be determined by the duty cycle of an associated canister purge valve solenoid (not shown) for each of the first and second canister purge valves, the duty cycle being determined by the vehicle's PCM, such as controller 12. Further, by commanding the first and second canister purge valves closed, the controller may seal the fuel vapor recovery system from the engine intake. Optional canister check valve(s) (not shown) may be included in first purge line 26 and second purge line 29 to prevent intake manifold pressure from flowing gases in the opposite direction of the purge flow.

In some examples, first canister purge valve may further comprise an adjustable valve, meaning its first flow cross-section may be set as a variable choke as a function of engine operating conditions by means of the PCM, such as controller 12. Alternatively, first canister purge valve may not comprise an adjustable valve, and instead may be a fixed flow cross-section, such that regulation of air/fuel vapor flow through the first canister purge valve may be controlled via the duty cycle of the first canister purge valve. The second canister purge valve may not comprise an adjustable valve, and instead may comprise a fixed flow cross-section, wherein regulation of air/fuel vapor flow is controlled via the duty cycle of the second canister purge valve.

In still other examples, the first canister purge valve and second canister purge valve may have the same flow cross-section. In other words, in some examples the first canister purge valve may not comprise a "low flow" valve, as compared to the second "high flow" valve. In such an example, both the first canister purge valve and second canister purge valve may be regulated by the duty cycle of each valves associated canister purge valve solenoid, as determined by the vehicle's controller 12.

Fuel system 18 and evaporative emissions system 19 may be operated by controller 12 in a plurality of modes by selective adjustment of the various valves and solenoids, as described above with regard to FIG. 1. For example, the fuel system and evaporative emissions system may be operated in a fuel vapor storage mode (e.g., during a fuel tank refueling operation and with the engine not running), wherein the controller 12 may open isolation valve 110 and canister vent valve 114 while closing first canister purge valve 112*a* and closing second canister purge valve 113*a*, to direct refueling vapors into canister 22 while preventing fuel vapors from being directed into the intake manifold.

As another example the fuel system and evaporative emissions system may be operated in a refueling mode (e.g., when fuel tank refueling is requested by a vehicle operator), wherein the controller 12 may open isolation valve 110 and canister vent valve 114, while maintaining first canister purge valve 112*a* and second canister purge valve 113*a* closed, to depressurize the fuel tank before enabling fuel to be added therein. As such, isolation valve 110 may be kept open during the refueling operation to allow refueling vapors to be stored in the canister. After refueling is completed, the isolation valve may be closed.

As yet another example, the fuel system and evaporative emissions system may be operated in a canister purging mode (e.g., after an emission control device light-off temperature has been attained and with the engine running). In one example, the controller 12 may first duty cycle first canister purge valve 112*a* while commanding or maintaining closed second canister purge valve 113*a*, and commanding open canister vent valve 114 while closing isolation valve 110. In such an example, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging in this fashion may be continued until the stored fuel vapor amount in the canister is below a predetermined threshold canister load. As described above, during purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. As described above, in one example, one or more exhaust gas oxygen sensors (not shown) may be positioned in the engine exhaust (not shown), engine intake 44, or coupled to the canister 22 to provide an estimate of a canister load. In other examples, canister load may be indicated by one or more temperature sensors 132 coupled to and/or within canister 22. For example, indicating canister load may be based on a temperature decrease while purging the fuel vapor canister.

Responsive to an indication that canister load is below a predetermined threshold canister load, in one example first canister purge valve 112*a* may be commanded closed, and second canister purge valve 113*a* may be duty cycled. By commanding closed first canister purge valve 112*a* and duty cycling second canister purge valve 113*a*, the pressure drop between the intake manifold vacuum and the fuel vapor canister may be reduced as compared to the pressure drop between the intake manifold vacuum and the fuel vapor canister resulting from duty cycling the first canister purge valve 112*a* with second canister purge valve 113*a* closed. As such, intake manifold vacuum may be directed full force right at canister 22, increasing air flow through the fuel vapor canister, and resulting in further purging of the fuel vapor canister.

In still other examples, such as an example where the first canister purge valve comprises a "low flow" valve and the second canister purge valve comprises a "high flow" valve, the controller 12 may first duty cycle first "low flow" canister purge valve 112*a*, while commanding or maintaining closed second "high flow" canister purge valve 113*a*, and commanding open canister vent valve 114 while closing isolation valve 110 as described above. Responsive to an indication of canister load below a predetermined threshold canister load, second "high flow" canister purge valve 113*a* may be commanded open, or duty cycled, while maintaining open first canister purge valve, thus increasing flow to the fuel vapor canister to further purge the canister of fuel vapors that did not get purged during duty cycling first "low flow" canister purge valve 112*a* while maintaining second "high flow" canister purge valve 113*a* closed. However, in other examples, first "low flow" canister purge valve 112*a* may be commanded closed responsive to an indication of canister load below the predetermined threshold canister load, while second "high flow" canister purge valve 113*a* may be duty cycled, or commanded to an open position, in an alternative approach to increasing flow through the fuel vapor canister to further desorb fuel vapors.

Furthermore, controller 12 may also be configured to intermittently perform evaporative emissions detection routines on fuel system 18 and evaporative emissions system 19 to confirm that the fuel system and/or evaporative emissions system is not degraded, according to the approaches described in detail with regard to FIG. 1.

Turning now to FIG. 3, a flow chart for a high level example method 300 for performing a purging operation of a fuel vapor canister, is shown. More specifically, method 300 may be used to purge a fuel vapor canister wherein a first canister purge valve, mounted at the intake manifold, and a second canister purge valve, mounted at the fuel vapor canister, are arranged in series. By first commanding open second canister purge valve, and duty cycling first canister purge valve, followed by duty cycling second canister purge valve while commanding open first canister purge valve, the fuel vapor canister may be thoroughly cleaned without relinquishing control over the regulating function of the first canister purge valve. In this way, a vehicle fuel vapor canister may be thoroughly cleaned, even under conditions of low intake manifold vacuum, and may thus reduce undesired bleed-through evaporative emissions resulting from incomplete removal of fuel vapors during purging operations. Method 300 will be described with reference to the systems described herein and shown in FIG. 1, though it should be understood that similar methods may be applied to other systems without departing from the scope of this disclosure. Method 300 may be carried out by a controller, such as controller 12 in FIG. 1, and may be stored at the controller as executable instructions in non-transitory memory. Instructions for carrying out method 300 and the rest of the methods included herein may be executed by the controller based on instructions stored on a memory of the controller and in conjunction with signals received from sensors of the engine system, such as the sensors described above with reference to FIG. 1. The controller may employ fuel system and evaporative emissions system actuators, such as first canister purge valve (e.g., 112), second canister purge valve (e.g., 113), canister vent valve (e.g., 114), fuel tank isolation valve (e.g., 110), etc., according to the method below.

Method 300 begins at 305 and includes evaluating current operating conditions. Operating conditions may be estimated, measured, and/or inferred, and may include one or more vehicle conditions, such as vehicle speed, vehicle location, etc., various engine conditions, such as engine status, engine load, engine speed, A/F ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc. Continuing at 310, method 300 may include indicating whether canister purging conditions are met. Purge conditions may include an engine-on condition, canister load above a threshold, an intake manifold vacuum above a threshold, an estimate or measurement of temperature of an emission control device such as a catalyst being above a predetermined temperature associated with catalytic operation commonly referred to as light-off temperature, a non-steady state engine condition, and other operating conditions that would not be adversely affected by a canister purge operation. If, at 310, purge conditions are not met, method 300 may proceed to 315, and may include maintaining current engine, evaporative emissions system, and fuel system status. For example, if it is indicated that the vehicle engine is off, the engine may be maintained off. In another example, if it is indicated that the vehicle engine is on, engine operation may be maintained according to current engine operating conditions. Furthermore, at 315, maintaining fuel system and evaporative emissions system status may include maintaining first canister purge valve (e.g., 112), second canister purge valve (e.g., 113), fuel tank isolation valve (e.g., 110), and canister vent valve (e.g., 114), in their current configurations. Method 300 may then end.

Returning to 310, if it is indicated that canister purge conditions are met, method 300 may proceed to 320. At 320, method 300 may include commanding open or maintaining open canister vent valve (e.g., 114). For example, there may be circumstances wherein canister vent valve may be in a closed confirmation during engine operating conditions, such as during an example condition where an evaporative emissions test is being conducted on the vehicle. If an evaporative emissions test was conducted, and the canister vent valve is not yet commanded open, the canister vent valve may be commanded open at 320. In other examples, the canister vent valve may be maintained open if already open, at 320.

Continuing to 325, method 300 may include commanding open second canister purge valve (e.g., 113) (e.g., open 100%), and duty cycling first canister purge valve (e.g., 112). As described above, vacuum generated by the intake manifold of the operating engine may thus draw fresh air through the fuel vapor canister (e.g., 22), to purge stored fuel vapors to the intake manifold (e.g., 44) for combustion. During purging, a learned vapor concentration may be used to determine the amount of fuel vapors stored in the canister. For example, oxygen sensors (e.g., 126) positioned in the engine exhaust manifold, engine intake manifold, or coupled to the canister (e.g., 22) may be used to estimate canister load. Additionally, canister load may be indicated based on temperature change as monitored via one or more temperature sensors (e.g., 132) coupled to and/or within the canister. By first commanding open second canister purge valve (e.g., 113), while duty cycling first canister purge valve (e.g., 112), "transport delay" between the first canister purge valve and the engine cylinders is minimized. In other words potential stall conditions resulting from transport delay may be avoided, by duty cycling first canister purge valve, where first canister purge valve is mounted at the intake manifold. If the first canister purge valve were first commanded open, and the second canister purge valve were duty cycled, if canister load was high, by the time an exhaust gas oxygen sensor indicated that the canister load is high, a potential stall condition may occur due to rich air/fuel mixture. As such, by commanding open second canister purge valve (e.g., 113) while duty cycling first canister purge valve (e.g., 112), sufficiently fine control over purging the fuel vapor canister is enabled, responsive to engine operating conditions. In some examples, the duty cycle of the first canister purge valve may be adjusted responsive to engine operating conditions, and may further adjusted based on canister load. For example, responsive to an indication that canister load is decreasing during a purging operation, and further based on engine operating conditions, the duty cycle of the first canister purge valve may be increased. Alternatively, if canister load is high and engine operating conditions indicate that further induction of fuel vapors into the engine may result in a potential stall condition, the duty cycle of the first canister purge valve may be correspondingly decreased accordingly.

Proceeding to 330, method 300 may include indicating whether fuel vapor canister load is below a predetermined threshold canister load. As described above, canister load may be indicated by one or more of oxygen sensors positioned in the engine exhaust manifold, intake manifold, or coupled to the canister, of via one or more temperature sensors coupled to and/or within the canister. In some examples, the predetermined threshold canister load may be a canister load indicating that the canister is nearly free of stored fuel vapors. For example, the predetermined threshold canister load may comprise a canister load of 25%, 20%, 15%, 10%, or less. Other examples have been contemplated, and the examples depicted herein are in no way meant to be limiting. Importantly, the predetermined threshold canister load may comprise a load which, if first canister purge valve were commanded open and second canister purge valve were duty cycled (or commanded open), where transport delay between second canister purge valve and the engine cylinders would be significant, the probability of potential stall conditions may be low since the canister is sufficiently clean. As such, at 330, if it is indicated that the canister load is not below the predetermined threshold canister load, method 300 may return to 325 and may include continuing to duty cycle the first canister purge valve while maintaining open the second canister purge valve, until it is indicated that canister load has reached the predetermined threshold canister load. Alternatively, at 330, if it is indicated that canister load has reached the predetermined threshold canister load, method 300 may proceed to 335. At 335, method 300 may include commanding open the first canister purge valve (e.g., open 100%), and duty cycling the second canister purge valve. As described above, by commanding open the first canister purge valve and duty cycling the second canister purge valve, the pressure drop between the intake manifold vacuum and the fuel vapor canister may be reduced as compared to the pressure drop between the intake manifold vacuum and the fuel vapor canister resulting from duty cycling the first canister purge valve and commanding open the second canister purge valve. In this way, duty cycling the second canister purge valve with the first canister purge valve open may direct intake manifold vacuum full force right at the canister, increasing air flow through the fuel vapor canister and thus further purging the fuel vapor canister. In some examples, duty cycling the second canister purge valve with the first canister purge valve open may include duty cycling the second canister purge valve at a predetermined rate. In other examples, the duty cycle of the second canister purge valve may be adjusted based on engine operating conditions. Additionally or alternatively, the duty cycling of the second valve may comprise a "closed valve" time sufficient for intake manifold vacuum directed at the second fuel vapor canister to develop to a predetermined threshold, and an "open valve" time comprising an amount of time where the level of vacuum directed at the canister is most likely to result in the further desorption of stored fuel vapors from the canister. In some examples, the closed valve times and open valve times may be predetermined times based on empirical evidence from diagnostic test procedures designed to maximize the further desorption of fuel vapors during duty cycling the second canister purge valve with the first canister purge valve open. Furthermore, duty cycling the second canister purge valve with the first canister purge valve open may include duty cycling the second canister purge valve for a predetermined time. Alternatively, the time frame for duty cycling the second canister purge valve may be based on canister load. For example, duty cycling the second canister purge valve with the first canister purge valve open may be stopped responsive to an indication that the fuel vapor canister is clean, and that no further desorption of fuel vapors is occurring.

As such, if second canister purge valve is duty cycled while first canister purge valve is maintained open for a predetermined time, or if it is indicated that further desorption of fuel vapors from the fuel vapor canister is not occurring, method 300 may proceed to 340. At 340, method 300 may include commanding closed first canister purge valve and commanding closed second canister purge valve, thus sealing the engine intake manifold from the fuel vapor canister.

Proceeding to 345, method 300 may include updating canister loading state, and updating the canister purge schedule. For example, the canister loading state may be updated to reflect the recent purge event. Updating the canister purge schedule at 345 may include scheduling further canister purge events responsive to the canister loading state indicated after the recent purge event. Method 300 may then end.

Turning now to FIG. 4, a flow chart for a high level example method 400 for performing a purging operation of a fuel vapor canister, is shown. More specifically, method 400 may be used to purge a fuel vapor canister wherein a first canister purge valve, close-coupled to an intake manifold of the engine, and a second canister purge valve, close-coupled to a fuel vapor canister, are arranged in parallel. By first duty cycling the first canister purge valve while maintaining the second canister purge valve closed, followed by duty cycling the second canister purge valve while commanding closed the first canister purge valve, the fuel vapor canister may be thoroughly cleaned without relinquishing control over the regulating function of the first canister purge valve. In this way, a vehicle fuel vapor canister may be thoroughly cleaned, even under conditions of low intake manifold vacuum, and may thus reduce undesired bleed-through evaporative emissions resulting from incomplete removal of fuel vapors during purging operations. Method 400 will be described with reference to the systems described herein and shown in FIG. 1 and FIG. 2, though it should be understood that similar methods may be applied to other systems without departing from the scope of this disclosure. Method 400 may be carried out by a controller, such as controller 12 in FIG. 2, and may be stored at the controller as executable instructions in non-transitory memory. Instructions for carrying out method 400 and the rest of the methods included herein may be executed by the controller based on instructions stored on a memory of the controller and in conjunction with signals received from sensors of the engine system, such as the sensors described above with reference to FIG. 1 and FIG. 2. The controller may employ fuel system and evaporative emissions system actuators, such as first canister purge valve (e.g., 112*a*), second canister purge valve (e.g., 113*a*), canister vent valve (e.g., 114), fuel tank isolation valve (e.g., 110), etc., according to the method below. Furthermore, numerous steps of method 400 are shared by method 300, and in an effort to avoid redundancy, steps that are common to both method 400 and method 300 will be briefly reiterated, but not described in full detail. However, it should be understood that any details depicted in method 300 for steps that are common to method 400 may be considered as applying to method 400.

Method 400 begins at 405 and includes evaluating current operating conditions. Operating conditions may be estimated, measured, and/or inferred, and may include one or more vehicle conditions, such as vehicle speed, vehicle location, etc., various engine conditions, such as engine status, engine load, engine speed, A/F ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc. Continuing at 410, method 400 may include indicating whether canister purging conditions are met. If canister purge conditions are not met, method 400 may proceed to 415, and may include maintaining current engine, evaporative emissions system, and fuel system status. For example, if it is indicated that the vehicle engine is off, the engine may be maintained off. In another example, if it is indicated that the vehicle engine is on, engine operation may be maintained according to current engine operating conditions. Furthermore, at 415, maintaining fuel system and evaporative emissions system status may include maintaining first canister purge valve (e.g., 112*a*), second canister purge valve (e.g., 113*a*), fuel tank isolation valve (e.g., 110), and canister vent valve (e.g., 114), in their current configurations. Method 300 may then end.

Returning to 410, if it is indicated that canister purge conditions are met, method 400 may proceed to 420. At 420, method 400 may include commanding open or maintaining open canister vent valve (e.g., 114).

Continuing to 425, method 400 may include commanding closed or maintaining closed the second canister purge valve (e.g., 113*a*), and duty cycling first canister purge valve (e.g., 112*a*). As described above, vacuum generated by the intake manifold of the operating engine may thus draw fresh air through the fuel vapor canister (e.g., 22), to purge stored fuel vapors to the intake manifold (e.g., 44) for combustion. During purging, a learned vapor concentration may be used to determine the amount of fuel vapors stored in the canister, according to the methods described above with regard to method 300. Maintaining second canister purge valve (e.g., 113*a*) closed while duty cycling first canister purge valve (e.g., 112*a*) minimizes the transport delay between the first canister purge valve and the engine cylinders, thus reducing potential for engine stall conditions. As described above, in some examples the duty cycle of the first canister purge valve may be adjusted responsive to engine operating conditions, and may further be adjusted based on canister load.

Proceeding to 430, method 400 may include indicating whether fuel vapor canister load is below a predetermined threshold canister load, according to the methods described above and with regard to method 300. In some examples, the predetermined threshold canister load may be a canister load indicating that the canister is nearly free of stored fuel vapors. For example, the predetermined threshold canister load may comprise a canister load of 25%, 20%, 15%, 10%, or less. Other examples have been contemplated, and the examples depicted herein are in no way meant to be limiting. Importantly, the predetermined threshold canister load may comprise a load which, if the first canister purge valve were commanded closed and the second canister purge valve were duty cycled (or commanded open), where transport delay between second canister purge valve and the engine cylinders would be significant, the probability of potential stall conditions may be low since the canister is sufficiently clean.

As such, at 430, if it is indicated that the canister load is not below the predetermined threshold canister load, method 400 may return to 425 and may include continuing to duty cycle the first canister purge valve while maintaining closed the second canister purge valve, until is it indicated that canister load has reached the predetermined threshold canister load. Alternatively, at 430, if it is indicated that canister load has reached the predetermined threshold canister load, method 400 may proceed to 435. At 435, method 400 may include commanding closed the first canister purge valve, and duty cycling the second canister purge valve. By commanding closed the first canister purge valve and duty cycling the second canister purge valve, the pressure drop between the intake manifold vacuum and the fuel vapor canister may be reduced as compared to the pressure drop between the intake manifold vacuum and the fuel vapor canister resulting from duty cycling the first canister purge valve while maintaining closed the second canister purge valve. As such, duty cycling the second canister purge valve with the first canister purge valve closed may direct intake manifold vacuum full force right at the canister, increasing air flow through the fuel vapor canister and thus further purging the fuel vapor canister. Similar to the method depicted in FIG. 3, duty cycling the second canister purge valve may include duty cycling the second canister purge valve at a predetermined rate. In other examples, the duty cycle of the second canister purge valve may be adjusted based on engine operating conditions. Additionally or alternatively, the duty cycling of the second valve may comprise a "closed valve" time sufficient for intake manifold vacuum directed at the second fuel vapor canister to develop to a predetermined threshold, and an "open valve" time comprising an amount of time where the level of vacuum directed at the canister is most likely to result in the further desorption of stored fuel vapors from the canister. In some examples, the closed valve times and open valve times may be predetermined times based on empirical evidence from diagnostic test procedures designed to maximize the further desorption of fuel vapors during duty cycling the second canister purge valve with the first canister purge valve closed. Furthermore, duty cycling the second canister purge valve with the first canister purge valve closed may include duty cycling the second canister purge valve for a predetermined time. Alternatively, the time frame for duty cycling the second canister purge valve may be based on canister load. For example, duty cycling the second canister purge valve with the first canister purge valve closed may be stopped responsive to an indication that the fuel vapor canister is clean, and that no further desorption of fuel vapors is occurring.

As such, if second canister purge valve is duty cycled while first canister purge valve is maintained closed for a predetermined time, or if it is indicated that further desorption of fuel vapors from the fuel vapor canister is not occurring, method 400 may proceed to 440. At 440, method 400 may include maintaining closed first canister purge valve and commanding closed second canister purge valve, thus sealing the engine intake manifold from the fuel vapor canister.

Proceeding to 445, method 400 may include updating canister loading state, and updating the canister purge schedule. For example, the canister loading state may be updated to reflect the recent purge event. Updating the canister purge schedule at 445 may include scheduling further canister purge events responsive to the canister loading state indicated after the recent purge event. Method 400 may then end.

FIG. 5 depicts an example timeline 500 for conducting a fuel vapor canister purging operation, wherein a first canister purge valve, mounted at the intake manifold, and a second canister purge valve, mounted at the fuel vapor canister, are arranged in series, using the method described herein with reference to FIG. 3. Timeline 500 includes plot 505, indicating whether fuel vapor canister purging conditions are met, over time. Timeline 500 further includes plot 510, indicating an open or closed status of a canister vent valve (CVV), over time. Timeline 500 further includes plot 515, indicating the open or closed status of a first canister purge valve (CPV) (e.g., 112), mounted at the intake manifold, over time. Timeline 500 further includes plot 520, indicating the open or closed status of a second CPV (e.g., 113), mounted at the fuel vapor canister, over time. Timeline 500 further includes plot 525, indicating the output of an exhaust gas oxygen sensor (e.g., UEGO), over time. Timeline 500 further includes plot 530, indicating a fuel vapor canister load, over time. Line 531 represents a predetermined threshold canister load, indicating that the canister is nearly free from stored fuel vapors.

At time $t_0$, the CVV is open, indicated by plot 510. Both the first CPV, indicated by plot 515, and the second CPV, indicated by plot 520, are closed. The engine is in operation, and the exhaust gas oxygen sensor (UEGO) indicates that the exhaust air/fuel ratio is at stoichiometry. The canister is saturated with fuel vapors, indicated by plot 530. However, at time $t_0$, purge conditions are not indicated to be met. As described above, purge conditions may include an engine-on condition, canister load above a threshold, an intake manifold vacuum above a threshold, an estimate or measurement of temperature of an emission control device such as a catalyst being above a predetermined temperature associated with catalytic operation (e.g., light-off temperature), a non-steady state engine condition, etc. As canister load is indicated to be high, yet canister purge conditions are not indicated to be met, it may be understood that intake manifold vacuum may be below a threshold, or that the emission control device has not reached the light-off temperature.

At time $t_1$, it is indicated that purge conditions are met. Accordingly, the CVV is maintained open, the second CPV is commanded open, and the first CPV is duty cycled. As such, vacuum generated by the intake manifold of the operating engine draws fresh air through the fuel vapor canister (e.g., 22), thus purging stored fuel vapors to the intake manifold (e.g., 44) for combustion. Between time $t_1$ and $t_2$, an indication of an exhaust gas air-fuel ratio is provided via exhaust gas oxygen sensor (e.g., UEGO), and the exhaust gas air-fuel ratio is indicated to become rich due to the canister load being high. By monitoring an indication of exhaust gas air-fuel ratio, a learned vapor concentration may be used to determine the amount of fuel vapors stored in the canister. As the UEGO indicates a rich response, it is further indicated that canister load is decreasing between time $t_1$ and $t_2$. In some example, canister load may additionally or alternatively be indicated based on temperature changes as monitored via one or more temperature sensors (e.g., 132) coupled to and/or within the canister.

At time $t_2$, the UEGO indicates that the exhaust gas air-fuel ratio has started to trend toward stoichiometry, rather than rich. Accordingly, between time $t_2$ and $t_3$, the duty cycle of the first CPV may be increased as the amount of fuel vapors inducted into the engine are less likely to result in potential stall conditions. By continuing to duty cycle the first CPV, canister load further decreases between time $t_2$ and $t_3$. At time $t_3$, canister load is indicated to cross the predetermined threshold canister load. As described above, the predetermined threshold canister load indicates a canister nearly free of fuel vapors. As the predetermined threshold canister load is reached at time $t_3$, the first CPV is commanded open at time $t_4$. With the first CPV open, duty cycling of the second CPV commences at time $t_5$. As described above, commanding open the first CPV and duty cycling the second CPV decreases the pressure drop between the intake manifold vacuum and the fuel vapor canister as compared to the pressure drop between the intake manifold vacuum and the fuel vapor canister resulting from duty cycling the first CPV and commanding open the second CPV. As such, the intake manifold vacuum may be directed full force at the fuel vapor canister. In this example, duty cycling the second canister purge valve comprises a defined "closed time" and a defined "open time", such that maximal further purging of the fuel vapor canister may be achieved. In some examples, the closed and open times may be based on the results of test diagnostics, conducted to indicate optimal desorption of fuel vapors from the fuel vapor canister. In other examples, the duty cycle of the second canister purge valve may be adjusted based on engine operating conditions. Furthermore, in this example, the second CPV is duty cycled for a predetermined amount of time, as long as canister purge conditions are still indicated to be met. As such, duty cycling of the second CPV continues from time $t_5$ to $t_6$, during which time canister load continues to slightly further decline. That the canister load is indicated to further slightly decline is indicative that the canister was further cleaned by the process of duty cycling the second CPV while maintaining the first CPV open, responsive to an indication that the canister load was below a predetermined threshold canister load. At time $t_6$, the predetermined amount of time for duty cycling the second CPV elapses, and as such, purge conditions are no longer indicated to be met. Accordingly, the first CPV and the second CPV are commanded closed. As the purging event is complete, the canister loading state and canister purge schedule may be updated to reflect the recent purge event.

FIG. 6 depicts an example timeline 600 for conducting a fuel vapor canister purging operation, wherein a first canister purge valve, close-coupled to an intake manifold of the engine, and a second canister purge valve, close-coupled to a fuel vapor canister, are arranged in parallel, using the method described herein with reference to FIG. 4. Timeline 600 includes plot 605, indicating whether fuel vapor canister purging conditions are met, over time. Timeline 600 further includes plot 610, indicating an open or closed status of a canister vent valve (CVV), over time. Timeline 600 further includes plot 615, indicating the open or closed status of a first CPV (e.g., 112*a*), close-coupled to the intake manifold, over time. Timeline 600 further includes plot 620, indicating the open or closed status of a second CPV (e.g., 113*a*), close-coupled to the fuel vapor canister, over time. Timeline 600 further includes plot 625, indicating the output of an exhaust gas oxygen sensor (e.g., UEGO), over time. Timeline 600 further includes plot 630, indicating a fuel vapor canister load, over time. Line 631 represents a predetermined threshold canister load, indicating that the canister is nearly free from stored fuel vapors. It may be understood that many aspects of timeline 600 are similar to those described in timeline 500, and in an effort to avoid redundancy, those aspects that are the same will be briefly reiterated here in FIG. 6. However, any details in FIG. 5 that are common to FIG. 6 may be understood to apply to the description of FIG. 6.

At time $t_0$, the CVV is open, indicated by plot 610. Both the first CPV, indicated by plot 615, and the second CPV, indicated by plot 620, are closed. The engine is in operation, and the exhaust gas oxygen sensor (UEGO) indicates that the exhaust air/fuel ratio is at stoichiometry. The canister is saturated with fuel vapors, indicated by plot 630. However, at time $t_0$, purge conditions are not indicated to be met.

At time $t_1$, it is indicated that purge conditions are met. Accordingly, the CVV is maintained open, the second CPV is maintained closed, and the first CPV is duty cycled. As such, vacuum generated by the intake manifold of the operating engine draws fresh air through the fuel vapor canister (e.g., 22), thus purging stored fuel vapors to the intake manifold (e.g., 44) for combustion. Between time $t_1$ and $t_2$, an indication of an exhaust gas air-fuel ratio is provided via exhaust gas oxygen sensor (e.g., UEGO), and the exhaust gas air-fuel ratio is indicated to become rich due to the canister load being high. By monitoring an indication of exhaust gas air-fuel ratio, a learned vapor concentration may be used to determine the amount of fuel vapors stored in the canister. As the UEGO indicates a rich response, it is further indicated that canister load is decreasing between time $t_1$ and $t_2$. In some examples, canister load may additionally or alternatively be indicated based on temperature changes as monitored via one or more temperature sensors (e.g., 132) coupled to and/or within the canister.

At time $t_2$, the UEGO indicates that the exhaust gas air-fuel ratio has started to trend toward stoichiometry, rather than rich. Accordingly, between time $t_2$ and $t_3$, the duty cycle of the first CPV may be increased as the amount of fuel vapors inducted into the engine are less likely to result in potential stall conditions. By continuing to duty cycle the first CPV, canister load further decreases between time $t_2$ and $t_3$. At time $t_3$, canister load is indicated to cross the predetermined threshold canister load. As the predetermined threshold canister load is reached at time $t_3$, the first CPV is commanded closed. With the first CPV closed, duty cycling of the second CPV commences at time $t_4$. As described above, commanding closed the first CPV and duty cycling the second CPV decreases the pressure drop between the intake manifold vacuum and the fuel vapor canister as compared to the pressure drop between the intake manifold vacuum and the fuel vapor canister resulting from duty cycling the first CPV with the second CPV closed. As such, the intake manifold vacuum may be directed full force at the fuel vapor canister. In this example, duty cycling the second canister purge valve comprises a defined "closed time" and a defined "open time", such that maximal further purging of the fuel vapor canister may be achieved. Furthermore, in this example, the second CPV is duty cycled for a predetermined amount of time, as long as canister purge conditions are still indicated to be met. As such, duty cycling of the second CPV continues from time $t_4$ to $t_5$, during which time canister load continues to slightly further decline. That the canister load is indicated to further slightly decline is indicative that the canister was further cleaned by the process of duty cycling the second CPV while maintaining the first CPV closed, responsive to an indication that the canister load was below a predetermined threshold canister load. At time $t_5$, the predetermined amount of time for duty cycling the second CPV elapses, and as such, purge conditions are no longer indicated to be met. Accordingly, the first CPV and the second CPV are commanded closed. As the purging event is complete, the canister loading state and canister purge schedule may be updated to reflect the recent purge event.

In this way, a fuel vapor canister of a vehicle evaporative emissions system may be thoroughly purged, without relinquishing control over how much fuel vapors are delivered to the engine under circumstances where the introduction of too much fuel vapor could potentially result in an engine stall condition.

The technical effect is to mount the first canister purge valve at the engine intake manifold and the second canister purge valve at the fuel vapor canister under circumstances wherein the valves are arranged in series, and to position the first canister purge valve close-coupled to intake and the second canister purge valve close-coupled to the canister when the valves are arranged in parallel. By positioning the first canister purge valve at the intake, the time lag between introducing fuel vapors to the engine, and monitoring exhaust air-fuel ratio is minimized. By positioning a second canister purge valve at the fuel vapor canister, increased air flow through the fuel vapor canister may be accomplished by reducing the pressure drop between the intake manifold vacuum and the fuel vapor canister. Selective control of the first and second canister purge valves thus enables precise control over the introduction of fuel vapors to the engine under conditions where precise control is advantageous, while enabling greater purging of the fuel vapor canister under conditions favorable to increased air flow through the fuel vapor canister. Accordingly, bleed-through emissions as a result of incomplete purging of the fuel vapor canister may be avoided, and the functional lifetime of fuel vapor canisters increased.

The systems described herein and with reference to FIGS. 1-2, along with the methods described herein and with reference to FIGS. 3-4, may enable one or more systems and one or more methods. In one example, a method comprises purging vapors stored in a storage canister into an intake of an engine through a first valve coupled to the intake and a second valve coupled to the canister; under a first set of conditions, regulating flow through the first valve and not regulating flow through the second valve; and under a second set of conditions, regulating flow through the second valve, and not through the first valve. In a first example of the method, the method further includes wherein the first set of conditions comprise: vapor load of the canister is above a threshold; or, vapor state of the canister is not known. A second example of the method optionally includes the first example and further includes wherein the second set of conditions comprise: vapor load of the canister is below a threshold; or, a rich response to an initiation of the purging is not indicated from an air/fuel sensor positioned in an exhaust of the engine. A third example of the method optionally includes any one or more or each of the first and second examples, and further comprises maintaining the second valve fully open when the vapor load is above the threshold and maintaining the first valve fully open when the vapor load is below the threshold.

Another example of a method comprises purging fuel vapors stored in a fuel vapor canister to an intake manifold of an engine; duty cycling a first canister purge valve and commanding open a second canister purge valve; and stopping duty cycling the first canister purge valve, opening the first canister purge valve, and commencing duty cycling the second canister purge valve responsive to a canister load below a threshold canister load. In a first example of the method, the method further includes wherein the first canister purge valve and the second canister purge valve are arranged in series. A second example of the method optionally includes the first example and further includes wherein opening the first canister purge valve and duty cycling the second canister purge valve increases air flow through the fuel vapor canister as compared to duty cycling the first canister purge valve and opening the second canister purge valve. A third example of the method optionally includes any one or more or each of the first and second examples, and further includes wherein opening the first canister purge valve and duty cycling the second purge valve results in the desorption of hydrocarbons from the fuel vapor canister that are not desorbed during duty cycling the first canister purge valve and commanding open the second canister purge valve. A fourth example of the method optionally includes any one or more or each of the first through third examples and further includes wherein the desorption of hydrocarbons from the fuel vapor canister that are not desorbed during duty cycling the first canister purge valve and commanding open the second canister purge valve reduces undesired evaporative emissions. A fifth example of the method optionally includes any one or more or each of the first through fourth examples and further comprises indicating an exhaust gas air/fuel ratio via an exhaust gas sensor; and wherein indicating canister load is further based on the exhaust air/fuel ratio as measured by the exhaust gas sensor. A sixth example of the method optionally includes any one or more or each of the first through fifth examples and further comprises indicating a temperature of the fuel vapor canister at one or more locations via one or more temperature sensors positioned within the fuel vapor canister; and wherein indicating canister load is further based on a temperature decrease while purging the fuel vapor canister. A seventh example of the method optionally includes any one or more or each of the first through sixth examples and further includes wherein purging fuel vapors stored in a fuel vapor canister to an intake manifold of an engine further comprises: selectively coupling the fuel vapor canister to atmosphere via a canister vent valve; selectively coupling the intake manifold to the fuel vapor canister via opening the first and second canister purge valves; wherein engine intake manifold vacuum draws fresh air into the fuel vapor canister; and wherein air drawn into the fuel vapor canister desorbs hydrocarbons from the fuel vapor canister and engine intake manifold vacuum routes the desorbed hydrocarbons to the engine for combustion.

An example of a system for a vehicle comprises a fuel tank configured within a fuel system; a fuel vapor canister configured within an evaporative emissions system, and coupled to the fuel tank that provides fuel to an internal combustion engine; an intake manifold of the internal combustion engine, coupled to the fuel vapor canister via a first canister purge valve and a second canister purge valve; a canister vent valve, positioned between the fuel vapor canister and atmosphere; a controller storing instructions in non-transitory memory, that when executed, cause the controller to: purge stored fuel vapors to the intake manifold of the engine for combustion by coupling the fuel vapor canister to atmosphere via the canister vent valve, and applying engine intake manifold vacuum to the fuel vapor canister by opening one or more of the canister purge valves to draw fresh air across the fuel vapor canister to desorb fuel vapors; and in a first condition, purging stored fuel vapors to an intake manifold of the engine by applying a first pressure drop between the intake manifold and the fuel vapor canister; in a second condition, purging stored fuel vapors to the intake manifold of the engine by applying a second pressure drop between the intake manifold and the fuel vapor canister; wherein the first pressure drop is greater than the second pressure drop; and wherein the first condition includes duty cycling a first canister purge valve and commanding open a second canister purge valve; wherein the second condition includes opening the first canister purge valve and duty cycling the second canister purge valve; wherein the first and second canister purge valves are arranged in series. In a first example, the system further includes wherein: distance between the intake manifold and the second canister purge valve is equivalent to the distance between the fuel vapor canister and the first canister purge valve. A second example of the system optionally includes the first example and further includes wherein: the first canister purge valve and the second canister purge valve are both normally closed solenoid-actuated valves. A third example of the system optionally includes any one or more or each of the first and second examples and further includes wherein: the first canister purge valve is mounted at the intake manifold, and the second canister purge valve is mounted at the fuel vapor canister. A fourth example of the system optionally includes any one or more or each of the first through third examples and further comprises an exhaust gas sensor positioned in an exhaust manifold of the engine; wherein the controller further stores instructions in non-transitory memory, that when executed, cause the controller to: indicate an exhaust air/fuel ratio via the exhaust gas sensor; and during the first condition and the second condition, indicate a fuel vapor canister load based on the indicated exhaust air/fuel ratio. A fifth example of the system optionally includes any one or more or each of the first through fourth examples and further includes wherein the controller further stores instructions in non-transitory memory, that when executed, cause the controller to: purge stored fuel vapors according to the first condition responsive to canister load above a predetermined threshold canister load or an unknown canister load; and purge stored fuel vapors according to the second condition responsive to the canister load below the predetermined threshold canister load. A sixth example of the system optionally includes any one or more or each of the first through fifth examples and further includes wherein the controller further stores instructions in non-transitory memory, that when executed, cause the controller to: during the first and second conditions, adjust the duty cycle of the first or second canister purge valve based on one or more of engine operating conditions, and/or canister load. A seventh example of the method optionally includes any one or more or each of the first through sixth examples and further comprises the first and second canister purge valves arranged in parallel, not in series, the first canister purge valve close-coupled to the intake manifold, and the second canister purge valve close-coupled to the fuel vapor canister; and wherein the controller further stores instructions in non-transitory memory, that when executed, cause the controller to: in the first condition, duty cycle the first canister purge valve while maintaining the second canister purge valve closed; and in the second condition, duty cycle the second canister purge valve while maintaining the first canister purge valve closed.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

regulating purging of vapors stored in a storage canister into an engine intake with a first valve coupled to the intake and a second valve coupled to the canister, by transitioning between:

under first conditions during the purging, regulating flow through the first valve, and not through the second valve; and under second, different, conditions during the purging, regulating flow through the second valve, and not through the first valve.

2. The method of claim 1, wherein the first conditions comprise: vapor load of the canister above a threshold; or, vapor state of the canister not known.

3. The method of claim 1, wherein the second conditions comprise: vapor load of the canister below a threshold; or, a rich response to an initiation of the purging not indicated from an air/fuel sensor positioned in an exhaust of an engine.

4. The method of claim 1, further comprising maintaining the second valve fully open when a vapor load is above a threshold and maintaining the first valve fully open when the vapor load is below the threshold.

5. A method for a vehicle comprising:

purging fuel vapors stored in a fuel vapor canister to an intake manifold of an engine;

during a canister purging with a canister vent valve open, duty cycling a first canister purge valve and commanding open a second canister purge valve; and stopping duty cycling the first canister purge valve, opening the first canister purge valve, and commencing duty cycling the second canister purge valve responsive to a canister load below a threshold canister load.

6. The method of claim 5, wherein the first canister purge valve and the second canister purge valve are arranged in series.

7. The method of claim 5, wherein opening the first canister purge valve and duty cycling the second canister purge valve increases air flow through the fuel vapor canister as compared to duty cycling the first canister purge valve and opening the second canister purge valve.

8. The method of claim 5, wherein opening the first canister purge valve and duty cycling the second canister purge valve results in a desorption of hydrocarbons from the fuel vapor canister that are not desorbed during duty cycling the first canister purge valve and commanding open the second canister purge valve.

9. The method of claim 8, wherein the desorption of hydrocarbons from the fuel vapor canister that are not desorbed during duty cycling the first canister purge valve and commanding open the second canister purge valve reduces undesired evaporative emissions.

10. The method of claim 5, further comprising:

indicating an exhaust gas air/fuel ratio via an exhaust gas sensor; and wherein indicating canister load is further based on the exhaust air/fuel ratio as measured by the exhaust gas sensor.

11. The method of claim 5, further comprising:

indicating a temperature of the fuel vapor canister at one or more locations via one or more temperature sensors positioned within the fuel vapor canister; and wherein indicating canister load is further based on a temperature decrease while purging the fuel vapor canister.

12. The method of claim 5, wherein purging fuel vapors stored in the fuel vapor canister to the intake manifold further comprises:

selectively coupling the fuel vapor canister to atmosphere via the canister vent valve;

selectively coupling the intake manifold to the fuel vapor canister via opening the first and second canister purge valves;

wherein engine intake manifold vacuum draws fresh air into the fuel vapor canister; and wherein air drawn into the fuel vapor canister desorbs hydrocarbons from the fuel vapor canister and engine intake manifold vacuum routes the desorbed hydrocarbons to the engine for combustion.

13. A system for a vehicle comprising:

a fuel tank configured within a fuel system;

a fuel vapor canister configured within an evaporative emissions system, and coupled to the fuel tank that provides fuel to an internal combustion engine;

an intake manifold of the internal combustion engine, coupled to the fuel vapor canister via a first canister purge valve and a second canister purge valve;

a canister vent valve, positioned between the fuel vapor canister and atmosphere; and a controller storing instructions in non-transitory memory, that when executed, cause the controller to:

purge stored fuel vapors to the intake manifold of the engine for combustion by coupling the fuel vapor canister to atmosphere via the canister vent valve by commanding open the canister vent valve, and applying engine intake manifold vacuum to the fuel vapor canister by opening one or more of the canister purge valves to draw fresh air across the fuel vapor canister to desorb fuel vapors;

in a first condition during purging, purging stored fuel vapors to the intake manifold of the engine by applying a first pressure drop between the intake manifold and the fuel vapor canister;

in a second condition during purging, purging stored fuel vapors to the intake manifold of the engine by applying a second pressure drop between the intake manifold and the fuel vapor canister;

wherein the first pressure drop is greater than the second pressure drop;

wherein the first condition includes duty cycling the first canister purge valve and commanding open the second canister purge valve;

wherein the second condition includes opening the first canister purge valve and duty cycling the second canister purge valve; and wherein the first and second canister purge valves are arranged in series.

14. The system of claim 13, wherein:

a distance between the intake manifold and the second canister purge valve is equivalent to a distance between the fuel vapor canister and the first canister purge valve.

15. The system of claim 13, wherein:

the first canister purge valve and the second canister purge valve are both normally closed solenoid-actuated valves.

16. The system of claim 13, wherein:

the first canister purge valve is mounted at the intake manifold, and the second canister purge valve is mounted at the fuel vapor canister.

17. The system of claim 13, further comprising:

an exhaust gas sensor positioned in an exhaust manifold of the engine;

wherein the controller further stores instructions in non-transitory memory, that when executed, cause the controller to:

indicate an exhaust air/fuel ratio via the exhaust gas sensor; and during the first condition and the second condition, indicate a fuel vapor canister load based on the indicated exhaust air/fuel ratio.

18. The system of claim 17, wherein the controller further stores instructions in non-transitory memory, that when executed, cause the controller to:

purge stored fuel vapors according to the first condition responsive to a canister load above a predetermined threshold canister load or an unknown canister load; and purge stored fuel vapors according to the second condition responsive to the canister load below the predetermined threshold canister load.

19. The system of claim 17, wherein the controller further stores instructions in non-transitory memory, that when executed, cause the controller to:

during the first and second conditions, adjust the duty cycle of the first or second canister purge valve based on one or more of engine operating conditions, and/or canister load.

20. The system of claim 17, further comprising:

the first and second canister purge valves arranged in parallel, not in series, the first canister purge valve close-coupled to the intake manifold, and the second canister purge valve close-coupled to the fuel vapor canister; and wherein the controller further stores instructions in non-transitory memory, that when executed, cause the controller to:

in the first condition, duty cycle the first canister purge valve while maintaining the second canister purge valve closed; and in the second condition, duty cycle the second canister purge valve while maintaining the first canister purge valve closed.

* * * * *